US011826665B1

(12) United States Patent
Ramsay

(10) Patent No.: US 11,826,665 B1
(45) Date of Patent: Nov. 28, 2023

(54) CRIBBAGE BOARD

(71) Applicant: Emmet P. Ramsay, Winston Salem, NC (US)

(72) Inventor: Emmet P. Ramsay, Winston Salem, NC (US)

( * ) Notice: Subject to any disclaimer, the term of this patent is extended or adjusted under 35 U.S.C. 154(b) by 0 days.

(21) Appl. No.: 18/356,621

(22) Filed: Jul. 21, 2023

(51) Int. Cl.
*A63F 3/00* (2006.01)
*A63F 1/04* (2006.01)

(52) U.S. Cl.
CPC ..... *A63F 3/00261* (2013.01); *A63F 3/00082* (2013.01); *A63F 1/04* (2013.01); *A63F 3/00643* (2013.01); *A63F 2003/00463* (2013.01)

(58) Field of Classification Search
CPC .... A63F 3/00261; A63F 3/00082; A63F 1/04; A63F 3/00643; A63F 2003/00463; A63F 11/0051; A63F 2011/0055
See application file for complete search history.

(56) References Cited

U.S. PATENT DOCUMENTS 2,755,024 A * 7/1956 Cox ..... A63F 1/06 235/90
4,183,533 A * 1/1980 Kulesza ..... A63B 65/12 124/36
4,521,675 A * 6/1985 Yakich ..... A63F 1/06 235/90
5,868,390 A * 2/1999 Ripley ..... A63F 3/00895 273/287
2006/0175753 A1* 8/2006 MacIver ..... A63F 3/00643 463/43

* cited by examiner

*Primary Examiner* — Michael D Dennis

(74) *Attorney, Agent, or Firm* — James G. Passe; Passe Intellectual Property, LLC

(57) ABSTRACT

A cribbage board having 2 skunk figures which are released when a cribbage player is skunked or double skunked.

4 Claims, 4 Drawing Sheets

CRIBBAGE BOARD

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a novel cribbage board. In particular, it relates to a cribbage board with 2 skunks that appear at appropriate times.

Description of Related Art

Cribbage, or Crib, is a card game, traditionally for two players, that involves playing and grouping cards in combinations which gain points. It can be adapted for three or four players.

Cribbage has several distinctive features: the cribbage board used for score-keeping; the crib during distinct scoring stages; and a unique scoring system, including points for groups of cards that total 15.

Visually, Cribbage is known for its scoring board—a series of 120 holes ("streets") for each player on which the score is tallied with pegs (also known as "spilikins"). A common $121^{st}$ hole is designated as the finish. Scores can be kept on a piece of paper, but a cribbage board is almost always used, since scoring occurs throughout the game, not just at the conclusion of hands as in most other card games.

Points are registered as having been scored by "pegging" along the crib board. Two pegs are used in a leapfrog fashion, so that if a player loses track during the count one peg still marks the previous score. Some boards have a "game counter" with many additional holes for use with a third peg to count the games won by each side.

If one person wins the game and the opponent has not reached the $91^{st}$ peg hole, that opponent is skunked. If at the end of a game the opponent has not reached the $61^{st}$ peg, that opponent is double skunked.

BRIEF SUMMARY OF THE INVENTION

The present invention relates to a cribbage board where one or two skunk figures pop out of the board at the appropriate time. When the winning player places a peg in the final $121^{st}$ hole the board determines where the opponent's peg is on the board and releases two skunks if between or on the first and $60^{th}$ peg hole and releases one skunk if the opponent's peg is between or on the $61^{st}$ and $90^{th}$ peg hole.

Accordingly, in one embodiment, there is a two-player cribbage board having 120 peg holes for each player and a single common $121^{st}$ peg hole for whichever player arrives at the end of a cribbage game first comprising:

a) a first and second spring loaded skunk figures;

b) a first sensor for determining when one player's peg is located in the $121^{st}$ hole;

c) a second sensor for determining which hole the second player's peg is located;

d) wherein when the second player's peg is in the $61^{st}$ to $90^{th}$ hole one skunk figure is released and when the second player's peg is in the first to $60^{th}$ peg hole, two skunk figures are released by a spring.

DETAILED DESCRIPTION OF THE INVENTION

Figure 1:
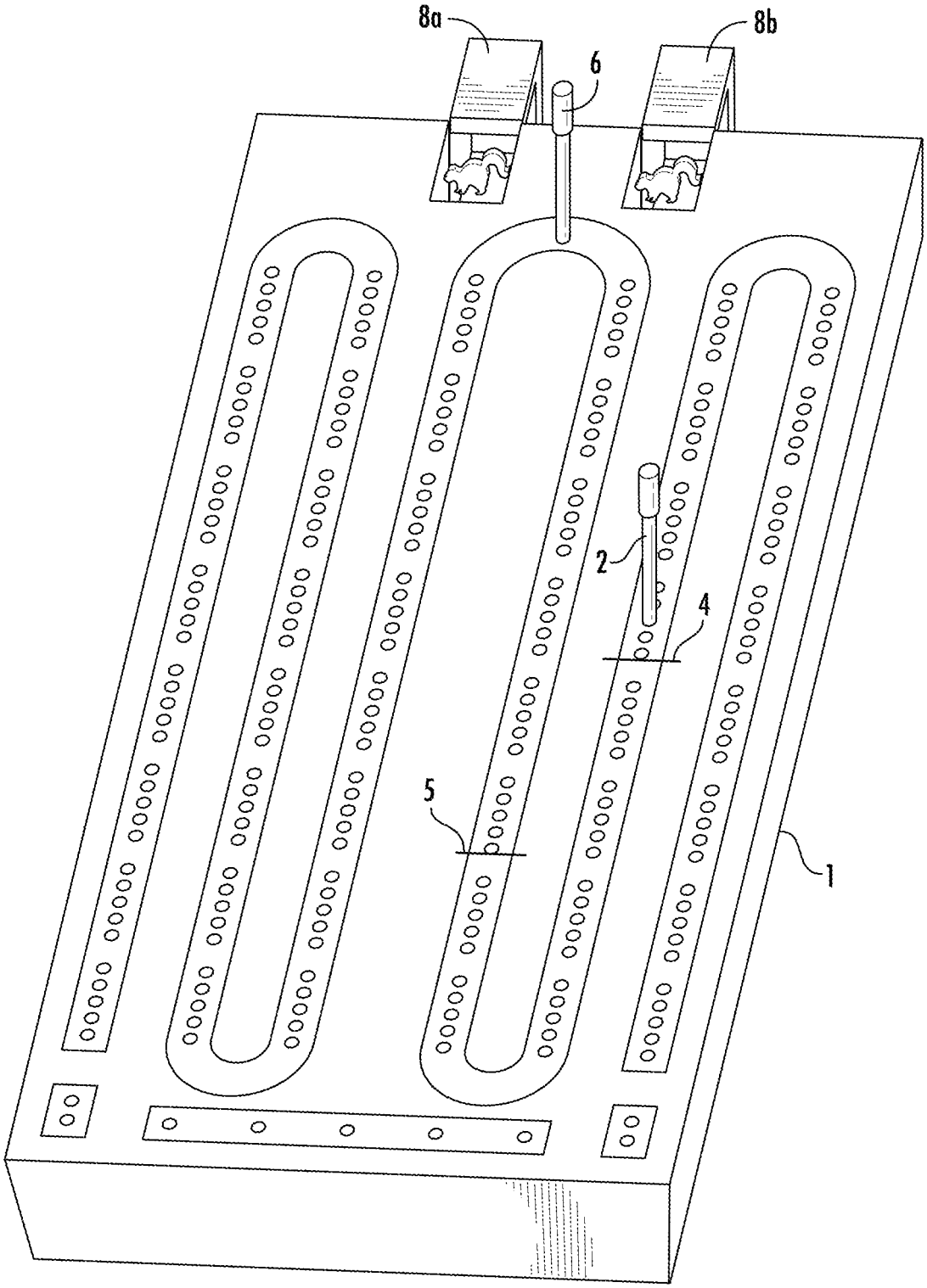
FIG. 1 is a perspective view of a 2-person cribbage board with two skunks having been released. In this view cribbage board 1 consists of 120 peg holes for each player and one common 121 hole 3. One player's peg 6 is in the $121^{st}$ hole.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

It is further noted that the claims may be drafted to exclude any element which may be optional. As such, this statement is intended to serve as antecedent basis for use of such exclusive terminology as "solely", "only" and the like in connection with the recitation of claim elements, or the use of a "negative" limitation.

The publications discussed herein are provided solely for their disclosure prior to the filing date of the present application. Nothing herein is to be construed as an admission that the present invention is not entitled to antedate such publication by virtue of prior invention. Further, the dates of publication provided may be different from the actual publication dates which may need to be independently confirmed. To the extent such publication may set out definitions of a term that conflict with the explicit or implicit definition of the present disclosure, the definition of the present disclosure controls.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "two-player" refers to a cribbage game where 2 people are playing against one another using a cribbage board with 120 holes per each player with a $121^{st}$ hole being a common hole.

As used herein, the term "cribbage board having 121 holes" refers to each player having 120 holes for their use for tracking score and one common, a $121^{st}$ hole, that the first player to win occupies.

As used herein, the term "spring loaded skunk figure" refers to 2 separate skunk figures hidden in the cribbage board which pop out when someone is skunked or double skunked. The figures are released when one player is in the $121^{st}$ common hole and the other player is at the $90^{th}$ hole or before. When the second player's peg is in the $61^{st}$ to hole one skunk figure is released and when the second player's peg is in the first to peg hole, two skunk figures are released at the end of the game. A spring spring refers to anything like metal springs, rubber bands, or other elastomers that act to propel the figures out from the inside of the board.

As used herein, the term "first sensor" refers to a mechanical device or an electronic device that senses a peg in the $121^{st}$ hole and releases zero, one or two skunk figures depending on which hole the opponent is in. A second sensor determines what hole the opponent's peg is in and releases skunks as necessary or blocks the unwonted skunks from being released. See the drawing for a mechanical version, but it is clear one could modify the cribbage board to be partially or fully electronic. For example, in one embodiment, the first sensor presses a bar or other device (see figures) which causes the 2 skunks to be release depending on where the opponents peg is. In another embodiment, electronic sensors and locks are used.

As used herein, the term "second sensor" refers to a mechanical or electronic device that determines which hole the opponents peg is in. If the opponent's peg is in the first through $60^{th}$ peg hole, two skunks are released. If the opponent's peg is in hole 61 to 90, one skunk is released. If the opponent is in the $91^{st}$ or higher hole, no skunk is released. In a mechanical version a first bar attached to the skunks underneath the cribbage board has holes lining up with the appropriate holes. The peg placed in these holes (through the holes on top of the cribbage board), which goes through the board into the corresponding holes in the sensor which releases skunks, or prevents the skunks from being released.

As used herein, the term "mechanical sensor" refers to a mechanical system which releases the skunks where a second sensor prevents the release of each of the skunks depending on where the opponents peg is located. It does so based on spring loaded mechanics and controlled by which hole the opponents peg is in. An example of such a system is shown in the figures As used herein, the term "electronic sensor" refers to electronics engaged by the peg insertions which achieve the same result as the mechanical release. Electronic release of the skunks and electronic blocking of their release can easily be configured in view of the disclosure herein.

DRAWINGS

Now referring to the drawings, FIG. 1 is a top view of a two-player cribbage board 1. There is a first peg 6 in the common $121^{st}$ hole 3. This peg's position in the $121^{st}$ hole represents the winner of a cribbage game. A second peg 2 represents the loser of the cribbage game and is positioned in the $58^{th}$ hole. This indicates a double skunk as detailed above. Shown are the $60^{th}$ hole 4 and the $90^{th}$ hole 5. The numbering of the holes is standard numbering for a cribbage game. Shown in this view are first skunk 8*a* and second skunk 8*b* which have both been released because the second peg 2 is between the $1^{st}$ and $60^{th}$ hole.

Figure 2:
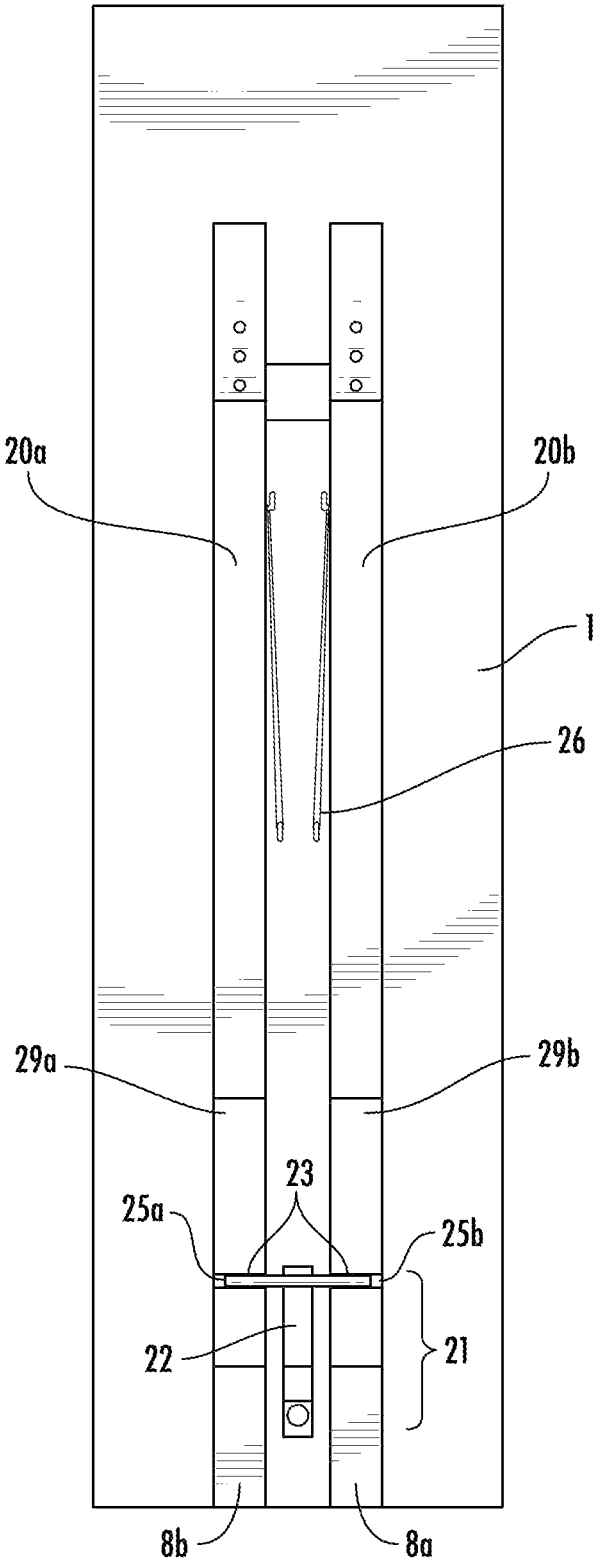
FIG. 2 is a bottom view of the cribbage board.

FIG. 2 is a bottom view of cribbage board 1. In this view the release mechanism 21 is shown. It comprises a hold down strap 22 with a latching bar 23. When peg 6 is inserted in the $121^{st}$ hole it pushes on hold down strap 22 thus lifting bar 23 which holds skunk bars 20*a* and 20*b* from being released because it is positioned in slots 25*a* and 25*b* powered by a spring 26 which in this embodiment are rubber bands. Latching bar 23, and skunk bars 20*a* and 20*b* are seen from their bottom so skunks 8*a* and 8*b* are not viewable. To prevent the skunk bars from coming completely out of the cribbage board 1 29*a* and 29*b* catch the lifting bar 23, thus limiting the travel outwardly of skunk bars 8*a* and 8*b*.

Figure 3:
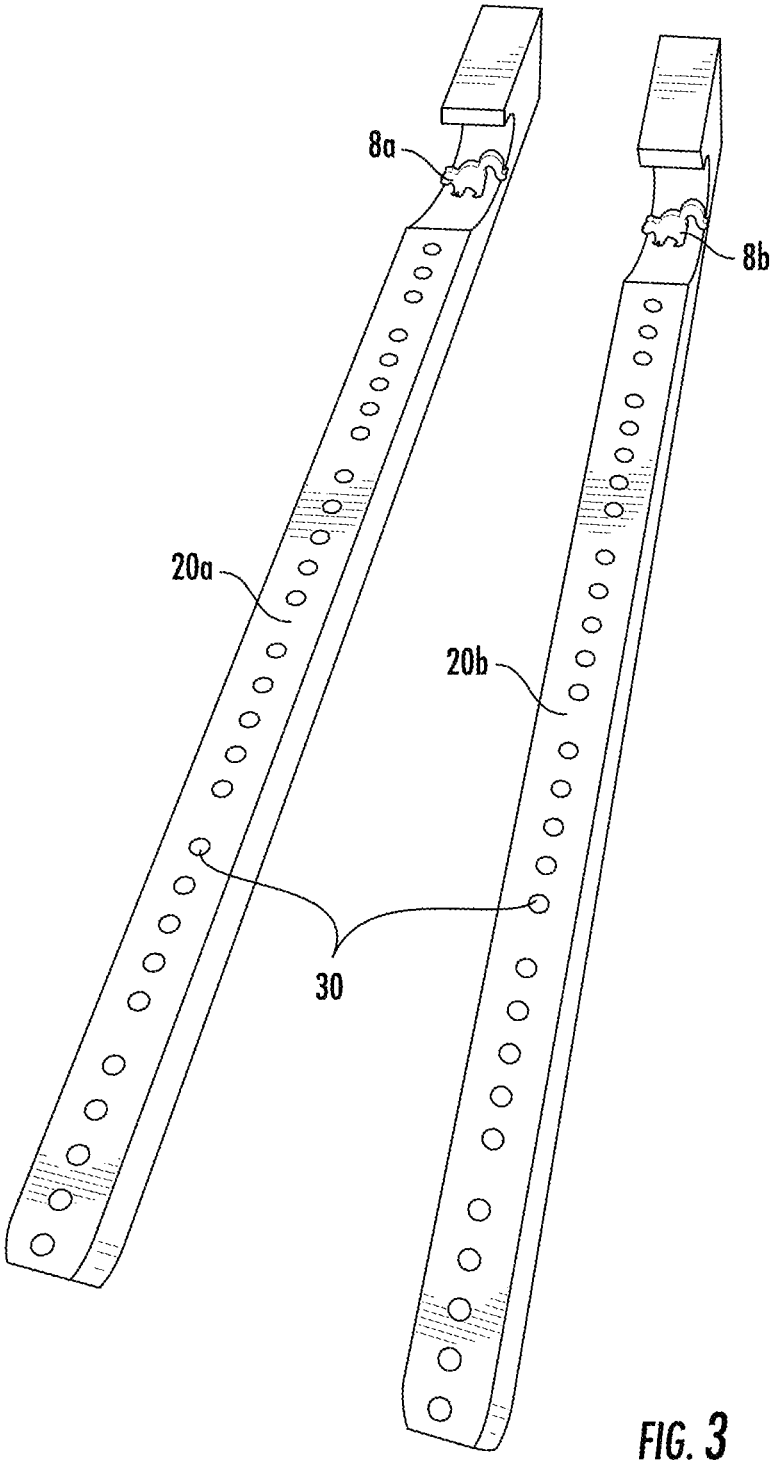
FIG. 3 is the bottom of the cribbage board showing the releasable skunks.

FIG. 3 shows skunk bars 20*a* and 20*b* from their topside where one can see the skunk FIGS. 8*a* and 8*b* and a view of holes. As can be seen in this view holes 30 which when the skunk bars are locked are directly below the holes in the cribbage board. One skunk bar's holes are positioned under holes 1 through 60 on the cribbage board and the other skunk bar's holes are positioned under holes 61 to 90. Thus, when the losing player's peg is inserted in the cribbage board it also enters into the corresponding holes below it in the skunk bars, preventing the skunk bar from release as described above.

Figure 4:
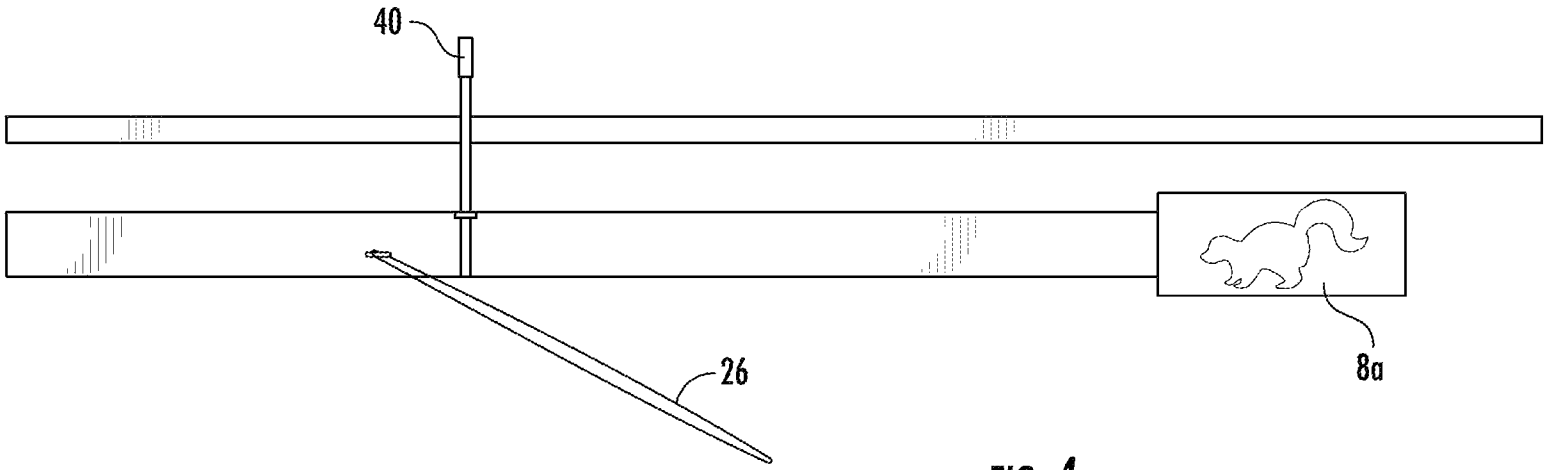
FIG. 4 is a side view of a peg in a board hole and also in a hole in the skunk bar.

FIG. 4 is a side view which depicts a peg 40 inserted into cribbage board 1 and continuing in to hole 41 in skunk bar 8*a*. This locks the skunk bar in place.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. A two-player cribbage board having 120 peg holes for each player and a single common $121^{st}$ peg hole for whichever player arrives at the end of a cribbage game first comprising:

a) a first and second skunk bar having a spring attached between the side of each skunk bar and the area in between the skunk bars, the springs positioned sufficient to eject the skunk bars from the cribbage board;

b) a holding strap with a latching bar which prevents the skunk bars from being ejected by positioning the latching bar in slots in each of the skunk bars wherein when the latching bar is released the skunk bars are ejected and wherein the skunk bars are prevented from ejecting all the way out of the cribbage board by a catch in each skunk bar which catches the latching bar when released and stops further movement of the movement of the skunk bars;

c) a first sensor for determining when one player's peg is located in the $121^{st}$ hole;

d) a second sensor for determining which hole the second player's peg is located;

e) wherein when the second player's peg is in the $61^{st}$ to $90^{th}$ hole one skunk figure is released and when the second player's peg is in the first to $60^{th}$ peg hole, two skunk figures are released by the spring.

2. The cribbage board according to claim 1 wherein at least one of the first and second sensors is a mechanical sensor.

3. The cribbage board according to claim 1 wherein at least one of the first and second sensor is an electronic sensor.

4. The cribbage board according to claim 1 wherein the spring is an elastomer.

* * * * *